US006321877B2

(12) United States Patent
Yamakawa

(10) Patent No.: US 6,321,877 B2
(45) Date of Patent: Nov. 27, 2001

(54) CONTROLLING APPARATUS FOR ELEVATOR WITH DIVIDED CONTROL PANEL

(75) Inventor: Shigeki Yamakawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/760,718

(22) Filed: Jan. 17, 2001

Related U.S. Application Data

(63) Continuation of application No. PCT/JP99/05853, filed on Oct. 22, 1999.

(51) Int. Cl.[7] ..... B66B 3/00

(52) U.S. Cl. ..... 187/391; 187/277; 187/414; 187/289

(58) Field of Search ..... 187/414, 391–374, 187/277, 289, 290, 247, 380, 382, 385

(56) References Cited

U.S. PATENT DOCUMENTS

| | | | | |
|---|---|---|---|---|
| 4,438,831 | * | 3/1984 | Rohanna | 187/30 |
| 4,742,891 | * | 5/1988 | Kunii et al. | 187/25 |
| 4,832,158 | * | 5/1989 | Farrar et al. | 187/103 |
| 5,714,726 | * | 2/1998 | Ketoviita | 187/391 |
| 6,148,962 | * | 11/2000 | Hakala et al. | 187/254 |
| 6,223,860 | * | 5/2001 | Namba et al. | 187/277 |

FOREIGN PATENT DOCUMENTS

| | | | |
|---|---|---|---|
| 58-162467 | | 9/1983 | (JP) . |
| 63-18-686 | | 7/1988 | (JP) . |
| 2-95692 | | 4/1990 | (JP) . |
| 9-267978 | | 10/1997 | (JP) . |
| 11-21036 | | 1/1999 | (JP) . |
| 11-322210 | | 11/1999 | (JP) . |
| 2000-159453-A | * | 6/2000 | (JP) . |
| 2000-302348-A | * | 10/2000 | (JP) . |
| 2000-318940-A | * | 11/2000 | (JP) . |

* cited by examiner

*Primary Examiner*—Jonathan Salata
(74) *Attorney, Agent, or Firm*—Leydig, Voit & Mayer, Ltd.

(57) ABSTRACT

A control panel is divided into units in accordance with each control function, units to be controlled by or connected to the divided unit are divided into unit groups in accordance with a place where the unit is to be disposed, and unit groups having a relationship form a control section, the control section being disposed in the vicinity of the unit group so that it is unnecessary to provide a large integral control panel. There is no difficulty in finding an installation place for the control panel, it is unnecessary to prepare a special machine room, it is possible to provide the control panel in an empty space around the respective unit to be controlled, and to effectively use the building while enhancing the layout of the units and it is possible to quickly control a localized situation for the unit to be controlled.

16 Claims, 10 Drawing Sheets

CONTROLLING APPARATUS FOR ELEVATOR WITH DIVIDED CONTROL PANEL

CROSS REFERENCE TO RELATED APPLICATION

This is a continuation of International Application PCT/JP99/05853, with an international filing date of Oct. 22, 1999, and designating the United States, the content of which is hereby incorporated by reference into the present application.

TECHNICAL FIELD

The present invention relates to a controlling apparatus for an elevator, and more particularly to an arrangement of a control board.

TECHNICAL BACKGROUND

FIG. 10 is a block diagram showing an overall structure of a controlling apparatus for an elevator, which does not require an elevator machine room, as shown in Japanese Patent Application Laid-Open No. Hei. 9-267978. Namely, a control board which has been installed in a conventional machine room is mounted on a car and in one piece with a door drive device that is mounted on the car.

In FIG. 10, numeral 1 denotes a hoist way, numeral 2 denotes a car, numeral 3 denotes a main rope, numeral 4 denotes a drive machine disposed within the hoist way for elevating/descending the car 2 through the rope 3, numeral 5 denotes a traction motor for driving the drive machine 4, numeral 6 denotes a control panel mounted within a car for performing an operational control of the car 2, a drive control of the traction motor 5 or the like, numeral 7 denotes a car operation panel mounted on an outer plate of the control panel 6 for registering a car call of destination floor, numeral 9 denotes a door motor for driving car doors 8, numeral 10 denotes a hall button for registering a hall call, numeral 11 denotes an alternating current power source, and numeral 20 denotes a power receiving unit in which a power receiving terminal of the alternating current power source 11 and junction terminal of cables.

In the structure shown in the drawing, the respective units are connected to each other through a cable 22 for connecting the power receiving unit 20 and the traction motor 5, a cable 21 for connecting the power receiving unit 20 and the control panel 6, a cable 23 for connecting the hall button 10 and the power receiving unit 20 and a cable 12 for connecting the door motor 9 and the control panel 6 to thereby enable the control panel 6 to control the respective units. The control panel 6 is provided within the car cabin to thereby dispense with a machine room. Also, it is possible to perform the maintenance of the control panel 6 from the car cabin to thereby attain the saving of the work of installation and maintenance.

However, in the conventional controlling apparatus for which the machine room is dispensed with, since the control panel 6 installed in the car 2 directly drives the traction motor 5, the cable 22 for the connection with the alternating current power source 11 and the motor drive power cable 21 must be wound between the power receiving unit 20 and the car 2.

In particular, in the case where the car travel is long or in the case where the car 2 has a large capacity and the drive power flowing through the cables becomes large, the following problem becomes remarkable. Namely, since the drive power cable requires substantially the same length as the car travel because the car 2 rises and descends, and at the same time, durability against repeated bending is required, the cost therefor is increased. Also, in the case where the traction motor 5 is inverter-driven, since a large current having a high frequency is caused to flow through the power cable, there is a fear that the current causes electromagnetic noise.

Also, since the control panel 6 is mounted on the car 2, the mass of the control panel 6 is added to the car 2, and in particular, in an elevator using a balance weight, it is necessary to increase the mass of the weight. Also, in addition to the increased mass, in accordance with the increase of the number of the cables, there is a problem in that the inertia efficiency is increased upon the drive of the car and power that is needed for acceleration/deceleration is also increased.

In order to cope with this problem, for example, in Japanese Patent Application Laid-Open No. Hei 11-21036, a main circuit part and a signal control section of the control panel are separated from each other in accordance with functions, the former is disposed in the vicinity of the traction machine and at the same time the latter is disposed inside and outside of the hoist way of the middle floors. According to this technique, the cable for the main circuit may be dispensed with, and also, the increase of the weight of the car may be restricted.

However, this prior art is simply directed to a technology in which the control panel is divided into an administrative control panel (the second control panel) for performing the signal control-that has been conventionally presented and a drive control panel (first control panel) for performing the drive control. Only the administrative control panel which has been installed in the same machine room or the first machine room and the second machine room is simply installed inside and outside of the hoist way of the middle floors. (Incidentally, there are many examples for installing the control panel inside and outside of the hoist way although not further explained.)

Also, recently, there is a description in, for example, Japanese Patent Application Laid-Open No. Hei 9-20470 that the control panel is manufactured to be divided in accordance with functions, after it has been carried into the site, the divided parts are combined, and the wirings are connected through connectors or the like. However, this is a simple technology that the conventional control panel is manufactured to be divided and combined and completely assembled in the site.

Recently, the electronics of the control panel have been developed and a separated control system using a microcomputer in accordance with a function has come to be used. Also, in the conventional control panel for an elevator, in particular, in a control panel for control in accordance with a relay sequence or the like, if the control panel is divided, a large number of signal lines for mutually sending/receiving signals are required. Accordingly, it is impossible to divide the control panel. However, a digital signal transmission system has been developed between microcomputerized electronic units and it is possible to perform the mutual sending and receiving signals even with a small number of signal lines.

Accordingly, the present invention has been made in view of the above-described various factors, and therefore has an object to provide a controlling apparatus for an elevator, provided with a control panel, which, without providing a large integral control panel, may be installed in an empty space around each controlled unit without preparing a special machine room, to be free from a problem in that it is difficult to install the control panel in place, which may enhance a layout property of the units and effectively utilize space in a building, and which may quickly perform control the controlled units while reflecting an actual localized situation.

SUMMARY OF THE INVENTION

A controlling apparatus for an elevator according to the present invention, which is provided with a control panel for controlling various units of the elevator, is characterized in that the control panel is divided into a plurality of divided units in accordance with every control function; and the divided units to be connected or to be controlled are divided into a plurality of unit groups mainly in accordance with a location where the units are disposed, a single or a plurality of divided unit groups composed of divided units having a strong relationship with at least one unit of the unit group are extracted to form a control section, and the control section is disposed in the vicinity of the unit group.

Furthermore, it is characterized in that a transmission system for mutual communication of signals between a plurality of control sections is further comprised.

Furthermore, it is characterized in that the transmission system transmits signals in serial transmission.

Furthermore, it is characterized in that the divided unit group comprises at least one of a divided unit composed of a drive control section for drivingly controlling a drive machine, a divided unit composed of a velocity supervising section for measuring and supervising a rotational condition of the drive machine and a divided unit composed of a velocity control section for controlling the drive control section in comparison with the rotational condition of the drive machine in accordance with a velocity command, and wherein the control section including the divided unit groups is disposed in the vicinity of the drive machine.

Furthermore, it is characterized in that the elevator is an elevator where the drive machine is disposed in a hoist way and the control section is disposed in the hoist way in the vicinity of the drive machine.

Furthermore, it is characterized in that the divided unit group comprises a divided unit composed of a car call registration section for registering a car call on the basis of an operation of a call button of a car operation panel provided in the car, and at least one of a divided unit composed of a call assignment section for selecting the call to be responded to for the registered call and responding to the call, a travel administration section for opening/closing doors of the car in response to the call and issuing a travel command, a velocity command section for outputting a command of travel velocity in response to a position where the car travels, and a divided unit composed of a car door control section for drivingly opening/closing the doors of the car, wherein the divided unit group is composed of at least two divided units, and wherein the control section including the divided unit group is disposed in the vicinity of the car operation panel.

Furthermore, it is characterized in that an openable door is formed on a portion of a wall, a floor or a ceiling forming the car cabin and the control section is received in the interior of the door.

Furthermore, it is characterized in that a front plate (face plate) of the car operation panel provided in the car, confronting the car cabin, is openable/closable, and the control section is received in the opened front plate.

Furthermore, it is characterized in that the divided unit group comprises at least one of a divided unit composed of a car door control section for drivingly controlling a door machine for opening/closing doors provided in the car, a divided unit composed of a door opening/closing supervising section for receiving a signal from a door opening/closing detector for detecting an opening/closing condition of the opening/closing doors and for supervising the doors, and a divided unit composed of a car devices supervising section for receiving a signal from a unit mounted around the car and for supervising the unit, wherein the control section including the divided unit group is mounted on the car.

Furthermore, it is characterized in that the divided unit group comprises at least one of a divided unit composed of a hall call registration section for registering a hall call on the basis of the operation of the call button of the hall operation panel provided at the hall and a divided unit composed of a hoist way/hall devices supervising section for receiving and supervising a signal from a unit mounted within the hoist way or the unit mounted at the hall, wherein the control section including the divided unit group is disposed in the vicinity of the hall or inside or outside of the hoist way.

Furthermore, it is characterized in that the divided unit group is a divided unit group including a divided unit composed of a power receiving section for receiving a power fed to the elevator from an local power substation of a building, and the control section including the divided unit group is disposed in the vicinity of the hall.

Furthermore, it is characterized in that a remote operation unit is mounted on a circuit breaker of a power receiving section for receiving a power fed from an local power substation of the building to the elevator, a remote operation switch for remotely operating the remote operation unit is provided at the hall, and the result of the operation of the remote operation switch is transmitted to the remote operation unit through the control section.

Furthermore, it is characterized in that a switch for a power circuit is mounted on a power receiving section for receiving a power fed from an local power substation of the building to the elevator, a remote operation switch for remotely operating the switch is provided at the hall, and the result of the operation of the remote operation switch is transmitted to the switch through the control section.

Furthermore, it is characterized in that the divided unit comprises at least one of a divided unit composed of a power receiving section for receiving a power fed from an local power substation of the building to the elevator, a divided unit composed of an environmental supervising section for inputting and supervising an electricity amount received by the power receiving section and for receiving an emergency signal detected by an emergency sensor, a divided unit composed of an operation supervising section for performing an operational administration of the elevator by outputting operation information of the elevator for alarming to an operator monitor panel or inputting the operation of the elevator inputted from the operator monitor panel, a divided unit composed of a remote supervising section for communication and control with a maintenance part for remotely supervising the elevator, wherein the control section including the divided unit is disposed in the vicinity of the hall of the elevator or an equipment administration chamber of the building for installing the elevator.

Furthermore, it is characterized in that the control section is a control section composed of at least one divided unit installed in the hoist way, an openable/closable outlet/inlet inside the car is provided in a ceiling portion of the car cabin, and a maintenance inspection of the control section is possible.

Furthermore, it is characterized in that the control section is disposed in the hoist way and positioned upwardly of an upper portion of the ceiling portion of the car cabin when the car stops at the uppermost floor.

BEST MODE FOR EMBODYING THE INVENTION

According to this invention, a control panel is divided in accordance with a plurality of functions, divided units are dispersed in the vicinity of particularly related units on the connection in accordance with the respective divided units, e.g., connection unit such as controlled units, or detectors or the like, and the respective units are connected with each other through signal lines to thereby communicate with each other to control and drive an elevator.

According to this, it is unnecessary to provide a large integral control panel. For instance, also in a system in which a drive machine is received within a hoist way and any machine room is not necessary, there is no fear that it is difficult to select an installation place of the control panel. Also, the divided units may be installed in the vicinity of the connected units. The mutual line connection may be performed easily.

In other words, a quick control is possible for the units to which the divided units are connected while reflecting a localized actual situation. Also, since only a specialized function is installed on each unit, it is possible to take its shape in conformity with the installation place in view of the installation property. As a result, without necessity of the large integral control panel as in the conventional technology, since the divided units are dispersedly arranged, it is possible to install the control panel in an empty space in the vicinity of the respective connection units without preparing a spacial machine room to thereby effectively utilize a building together with the enhancement of the layout property of the units.

Embodiment 1

Figure 1:
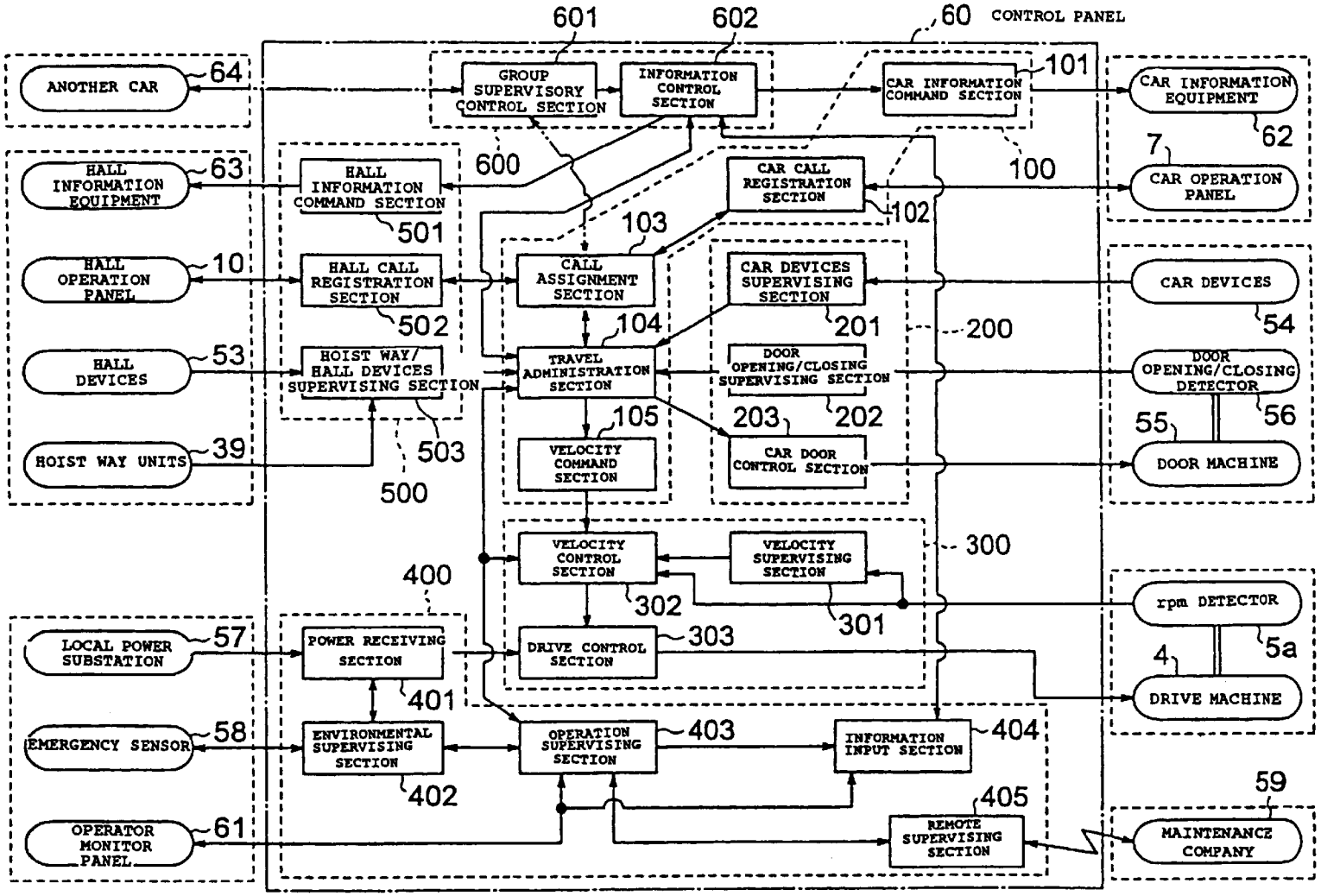
FIG. 1 is an overall structural view showing a connection relationship with peripheral devices while dividing a control panel of an elevator in accordance with every control function in embodiment 1 of this invention.

FIG. 1 is an overall structural view showing a connection relationship with peripheral devices while dividing a control panel of an elevator in accordance with every control function in embodiment 1 of this invention. FIG. 1 shows the connection of peripheral devices (surrounded by round rectangular solid lines) of the control panel while further dividing control panel functions of the elevator (the region surrounded by one-dot-and-dash lines in the drawing) in accordance with every function (surrounded by a rectangular solid line).

Figure 2:
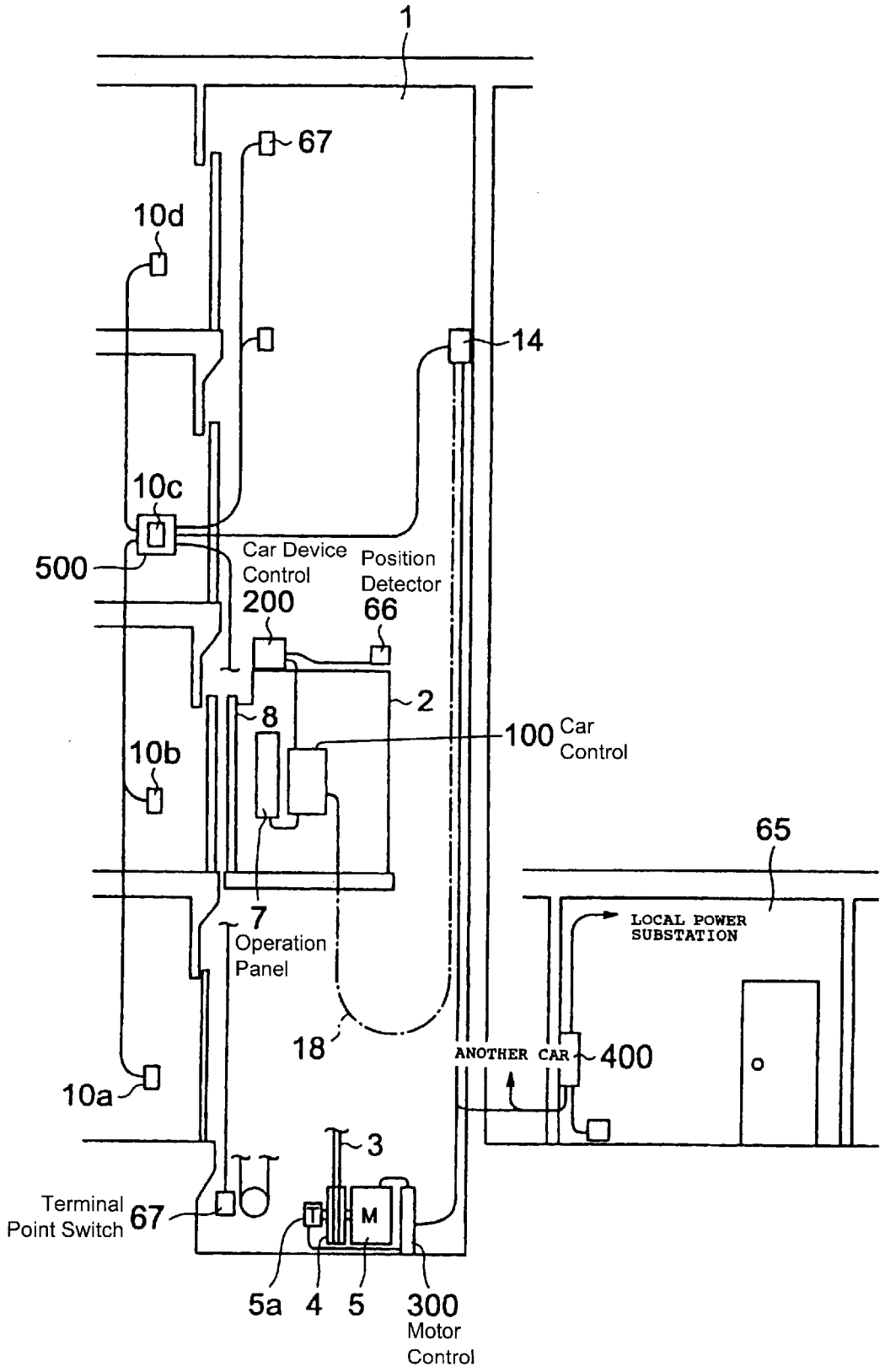
FIG. 2 is a unit connection arrangement view concretely showing the structure shown in FIG. 1.
Figure 3:
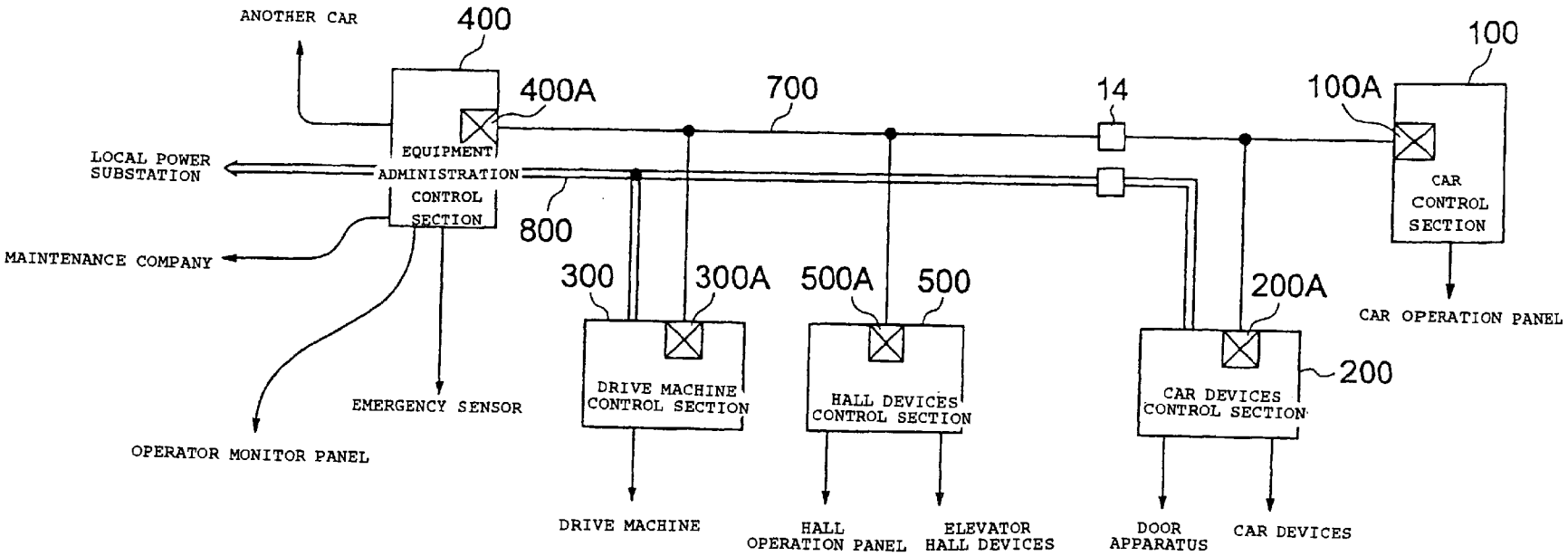
FIG. 3 is a structural view showing a transmission system for mutually connecting the structure shown in FIG. 2.

Also, FIG. 2 is a unit connection arrangement view concretely showing the connection arrangement of the structure shown in FIG. 1. Furthermore, FIG. 3 is a structural view showing a signal transmission system for mutually connecting the structure shown in FIG. 2.

As shown in FIG. 1, the control panel 60 in accordance with this invention is disposed at a position where it may be accessed from the inside of a car 2 (see FIG. 2). In particular, the control panel has a car control section 100 for controlling units operated by the passengers or the like, a car devices control section 200 for controlling units mounted around the car 2 or obtaining signals therefrom, drive machine control section 300 mounted on a drive machine 4 (see FIG. 2) for performing the drive control of the drive machine 4, an equipment administration control section 400 provided in, for example, a maintenance room 65 (see FIG. 2) and provided with a circuit breaker or switch (not shown), which may turn on or off a power source, for performing the equipment administration control, and switches for remotely operating the turn-on and -off of the power source. The panel is divided in accordance with every function by a group administration control section 600 and a hall devices control section 500 installed within a hoist way 1 (see FIG. 2) or the hall for controlling the units.

Here, the above-described car control section 100 is provided with divided units for control panel functions of a car information command section 101, a car call registration section 102, a call assignment section 103, a travel administration section 104 and a velocity command section 105. Also, the above-described car devices control section 200 is provided with divided units for control panel functions of a car devices supervising section 201, a door opening/closing supervising section 202 and a car door control section 203. Also, the above-described drive machine control section 300 is provided with divided units for control panel functions of a velocity supervising section 301, a velocity control section 302 and a drive control section 303. Also, the above-described equipment administration control section 400 is provided with divided units for control panel functions of a power receiving portion 401, an environmental supervising section 402, an operation supervising section 403, an information input section 404 and a remote supervising section 405. Also, the above-described hall devices control section 500 is provided with divided units for control panel functions of a hall information command section 501, a hall call registration section 502 and a hoist way/hall devices supervising section 503. Furthermore, the group administration control section 600 is provided with divided units for control panel functions of a group administrating section 601 and an information control section 602.

The operational contents concerning the above-described structure will now be described.

A call is registered in the hall call registration section 502 by operating the hall call buttons (10*a* to 10*d*: see FIG. 2) provided on the hall operation panels 10 and the responding operation is determined at the call assignment section 103 for the call, the car 2 is traveled by the travel administration section 104 to the floor where the hall call is present.

In order to travel the car 2, the information such as the car 2 position information or travel condition from the hall devices 53 or the hoist way unit 39 is introduced into the hoist way/hall devices supervising section 503 and transmitted to the travel administration section 104 as the administration information. Also, in the same manner, the information such as the car 2 position information or travel condition from the car devices 54 is introduced into the car devices supervising section 201 and transmitted to the travel administration section 104 as the administration information.

In the travel administration section 104, when the car 2 has reached the floor where the hall call is registered, a drive control of a door machine 55 is commanded to the car door control section 203 for controlling car doors 8 (see FIG. 2) to thereby open/close doors. The information of the opened/closed condition of the doors is collected by a door opening/closing detector 56 and introduced into the door opening/closing supervising section 202 to be transmitted to the travel administration section 104 as administration information.

As the result of which the passenger rides on the car 2 and operates the car call button (not shown) provided on the car operation panel 7 (see FIG. 2), the preceding call for a floor is registered in the car call registration section 102 and the responding of the call assignment section 103 is determined for the call. If so, the travel administration section 104 causes the car to the floor where the car call is present.

In order for the travel administration section 104 to travel the car, when the travel is commanded to the velocity command section 105, a velocity pattern produced in accordance with a maximum velocity or a predetermined acceleration/deceleration velocity is generated in the velocity command section 105, the velocity control is executed in accordance with the above-described velocity pattern by using the data for which the rotational condition of the drive machine 4, i.e., the rotational velocity or the like is detected by a rotation detector 5*a* (see FIG. 2) in the velocity control section 302. Also, the information detected by the rotation detector 5*a* is introduced into the velocity supervising section 301 and judged so that the velocity abnormality or the like is supervised to perform the safe operation.

The drive control section 303 receives a power from an local power substation 57 of a building through a power receiving section 401 and controls the electric supply for the drive machine 4 in accordance with a command of the velocity control section 302 to thereby control the rotation of the drive machine 4. Incidentally, the power receiving section 401 is provided with a so-called breaker or switch for interrupting the power source upon abnormality such as overcurrent on the elevator side and for cutting the power supply as desired as in maintenance work or the like.

The operational information, that should be coped with on the elevator side, such as emergency information detected by an emergency sensor 58 such as a fire alarm or an earthquake sensor and a consumption power of the elevator obtained by the power receiving section 401 is supervised by the environmental supervising section 402. The supervised information is noticed to the operation supervising section 403 to command the travel administration section 104 or the velocity control section 302 with the operation pause or a so-called special mode operation such as an emergency operation.

Also, the operation supervising section 403 supervises the operation on the basis of the information obtained from the travel administration section 104 or the velocity control section 302 and at the same time, is remotely supervised by a maintenance company 59 in the neighborhood through the remote supervising section 405. On the other hand, the command is received from the operator monitor panel 61 installed in the administration chamber of the building or the like and the operation supervising information is displayed on the operator monitor panel 61.

The command from the specialized input unit (not shown) provided in the operator monitor panel 61, for example, the command from the operator monitor panel 61 is inputted into the information input section 404 through the operation supervising section 403. Also, the operation supervising information from the operation supervising section 403 is inputted into the information input section 404. These pieces of information are fed to the information control section 602 by the information input section 404.

In the information control section 602, after the display information has been organized in order to prepare a display image, for example, the image information is displayed to the car information equipment 62 provided within the car 2 by the car information command section 101 for the car 2. Also, for the hall or the like, in the same manner, the image information is displaced by the hall information command section 501 on the hall information equipment 63 provided in the hall. Incidentally, although the image information is displayed on the display here, it is possible to obtain the same function as that of the information alarm unit by using a sound as the information guide.

Also, in the case where a so-called group administration control for administering a plurality of elevators in accordance with a group rather than control of a single elevator is to be performed, the group supervisory control section 601 in communication with another car 64 in the control information, whose relationship is shown in two-dot-and-dash lines in the drawing, is provided to function the call assignment section 103 on the basis of the command from the group supervisory control section 601 to thereby perform the control operation of each car.

The divided functions of the control panel 60 and the arrangement of the peripheral devices of the control panel 60 will now be described.

In the arrangement shown in FIG. 1, the peripheral devices (units to be controlled) of the control panel are grouped in accordance with their locations of the arrangement and are depicted in the regions surrounded by the dotted lines. Also, the divided functions of the control panel 60 are grouped in view of the relationship with the associated peripheral devices and surrounded by the dotted lines in the same manner. Incidentally, the peripheral devices of the control panel 60 or the divided functions of the control panel 60 shown in this embodiment are examples and the arrangement is not limited to that shown. Also, the grouping manner is not limited to that of the embodiment but there are many grouping methods. In short, the functions of the control panels which have deep relationships with the peripheral devices are divided, and arranged to be grouped and related to each other.

As the peripheral devices, the local power substation 57, the emergency sensor 58 and the operator monitor panel 61 are mainly related to the building, and in particular the elements related to the equipment of the building. Accordingly, as the divided units related to these components, the power receiving section 401, the environmental supervising section 402, the operation supervising section 403 and the information input section 404 are preferably installed to be divided in the vicinity of the equipment region of the building.

In many cases, a chamber is prepared in a basement of the building for the equipment region. Accordingly, it is conceivable that the equipment region may be provided in that chamber or an integral panel collecting these components may be embedded in a Ad wall or the like in the vicinity of the hall in the basement. Also, since the operation supervision is performed as a remote supervision from the maintenance company, the remote supervising section 405 may be installed together with the operation supervising section 403 and may be arranged together with the above-described divided unit.

Also, as described above, the divided unit for the equipment system is installed in a place remote from the hall of the elevator. In particular, there is a necessity to interrupt a main circuit of the power receiving section 401 upon maintenance work. Namely, it is necessary to interrupt the power source for the purpose of safety when the maintenance person enters, for example, in the hoist way. Accordingly, the remote operation unit is mounted on the power receiving section 401 to make it possible to perform the remote operation, a non-fuse breaker (so-called circuit breaker) is provided, or a switch (switch contactor) is provided so that the main circuit may be cut off. An operation unit such as operation buttons may be provided on another divided unit in the vicinity of the hall where the operation is easy.

The rotation detector 5*a* drives the drive machine 4 and has a strong relationship with the drive control section 303, the velocity supervising section 301 and the velocity control section 302 for detecting the rpm. These components may preferably be installed in the vicinity of the drive machine 4.

With respect to the hoist way unit 39, the hall devices 53, the hall operation panel 10 and the hall information equipment 63, since these units are units fixed to the building around the hoist way 1, they are grouped together. The hoist way/hall devices supervising section 503, the hall call registration section 502 and the hall information command section 501 which are the divided units relating to these units are installed as a single panel within the hoist way or in the vicinity of the hall. Incidentally, in the case where the number of the stops for the floors, i.e., the number of the floors which is subjected to a service is increased, since their size and number to be connected to each other is too increased for a single panel. In such a case, for example, they are arranged to be divided into upstairs and downstairs of the hoist way 1 and thus may be arranged to be divided as desired.

With respect to the door machine 55, the door opening/closing detector 56 and the car devices 54, since these units are units to be installed around the car 2, the control factors composed of the car door control section 203, the door opening/closing supervising section 202 and the car devices supervising section 201 which are the divided units relating to these units may be installed around the car, for example, in the well-known door apparatus (not shown) provided on the car 2.

With respect to the car operation panel 7 and the car information equipment 62, since these units are units by which the passengers within the car 2 may access or obtain the information, they are installed within the car. As the divided units having the strong relationship with these units, there are the car call registration section 102 and the car information command section 101. Since these units are intimately related to the passengers, they are installed in a place where they may be operated also inside the car 2.

Furthermore, in this embodiment, in order to facilitate the access of the maintenance person upon the maintenance work, the travel administration section 104 for performing the central administration of the operation, the call assignment section 103 and the velocity command section 105 are also arranged to the place where these units may be accessed inside the car 2 together with the divided units. For example, a part of the wall of the car cabin may be openable/closable and the control panel composed of the divided unit group may be provided therein or may be provided on the back side of the car operation panel, i.e., in an opening section of a front plate of the operation panel.

With respect to the group supervisory control section 601 or the information control section 602, since the former section is an important control factor in collocation with not only the subject car but also another car 64 and the latter section has a large necessity to alarm the information through the information alarm including the relationship with the other car in the case where the latter section is installed in the hall. In the case where, the travel administration section 104 of each car is installed in the place where the signal exchange with the other car is easy, for example, in the car, the divided units may be installed in the vicinity of the junction box 14 in an intermediate portion within the hoist way. Also, although not shown in FIGS. 1 and 2, the units may be installed together with the operation supervising section 403 which is the information center relating to the elevator and may be installed in the administration chamber of the equipment region.

Incidentally, although not shown in FIG. 1, as the units to be connected to the control panel 60, as shown in FIG. 2, in addition to the above-described units, for example, there are a bottom touch position detector 66 mounted on the car 2, a terminal point switch 67 mounted within the hoist way, an earthquake sensor 68 provided in the maintenance room 65 or the like. The units to be connected to the control panel 60 are not limited to those shown in FIGS. 1 and 2. Also, in FIG. 2, numeral 3 denotes a main rope for suspending the car 2, numeral 5 denotes a traction motor for driving the drive machine 4, numeral 14 denotes a junction box for a signal (particularly a joint point with a travelling cable and the elevating/descending car), and numeral 18 denotes the traveling cable which is a control cable having a bending durability for connecting the elevating/descending car and the fixed point on the building side.

Also, as shown in FIG. 3, the above-described respective control sections 100, 200, 300, 400, 500 and 600 are connected by signal transmission line 700 and a power line 800 and connected to the elevator units having a strong positional relationship for each control section.

Transmission systems 100A, 200A, 300A, 400A, 500A and 600A are provided at the joint portions with the signal transmission line 700 of the respective control sections. The respective control sections are connected together to perform the transmission of signals and the communication of signals by utilizing a so-called serial transmission between the respective transmission systems. Accordingly, the number of the signal transmission lines is decreased to realize the signal transmission to simplify the line arrangement. Incidentally, although it has been described that the signals may be sent and received by the signal transmission line, the actual application is not limited to this arrangement. A wireless transmission may be realized by a transmission system to thereby dispense with the signal transmission line.

Embodiment 2

Figure 4:
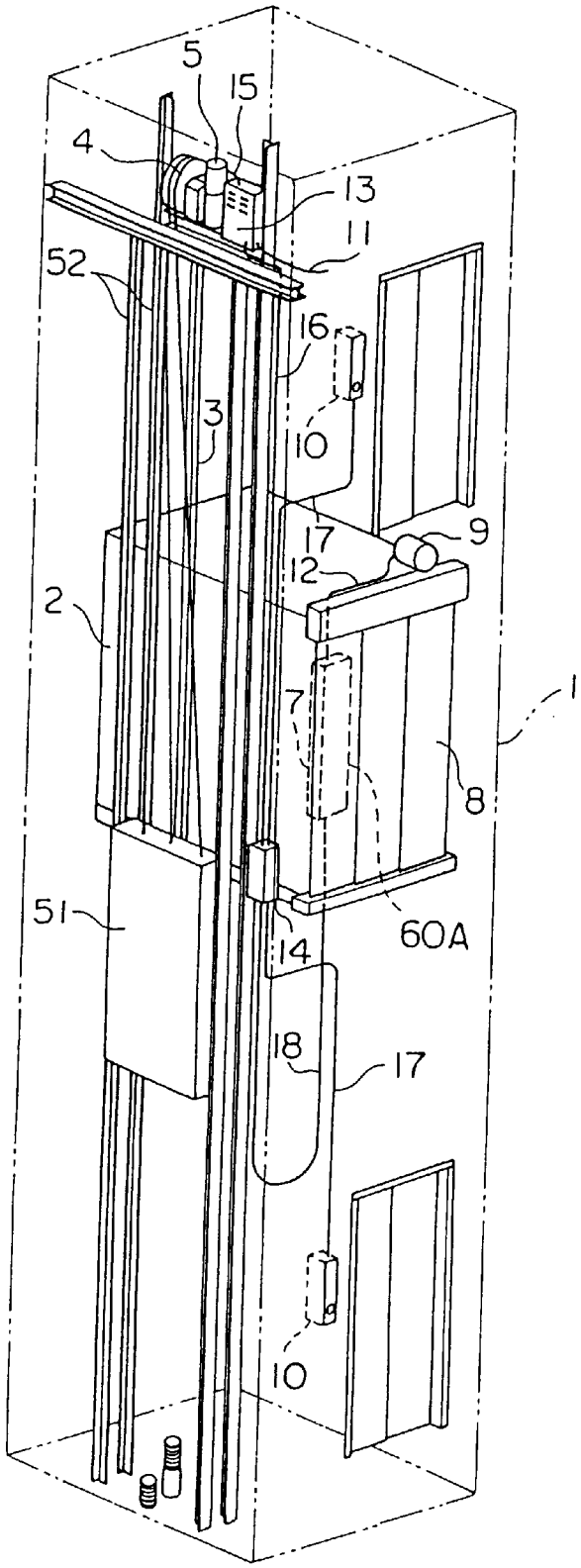
FIG. 4 is an overall structural view showing an elevator in accordance with embodiment 2 of this invention, in which no machine room is provided.

FIG. 4 is an overall structural view showing an elevator where no machine room is provided in accordance with embodiment 2 of this i invention, and is a view of a traction type in which a drive machine 4 is disposed in an upper portion of a hoist way 1.

In FIG. 4, the same reference numerals are added to indicate the same structure as that of FIG. 10 and FIGS. 1 to 3. Numeral 4 denotes a drive machine for elevating and descending a car 2 installed in the upper portion of the hoist way 1, numeral 13 denotes a traction motor drive unit (also serving as a power source receiving function) installed immediately in the vicinity of the drive machine 4, and numeral 14 denotes a junction box installed in the hoist way 1 for relaying a cable between the car 2 and the hoist way installation unit. Also, numeral 15 denotes a cable for connecting the traction motor drive unit 13 and the traction motor 5, numeral 16 denotes a cable for connecting the traction motor drive unit 13 and the junction box 14, numeral 17 denotes a cable for connecting a hall button 10 and the junction box 14, numeral 18 denotes a cable for connecting the junction box 14 and a control panel 60A relating to this embodiment (which incidentally does not include the function corresponding to the traction motor drive unit 13 unlike the conventional control panel 6), numeral 51 denotes a balance weight for the car 2, numeral 3 denotes a main rope for suspending the car 2 and the balance weight 51, and numeral 52 denotes guide rails for guiding the travel of the car 2 and the balance weight 51.

Figure 5:
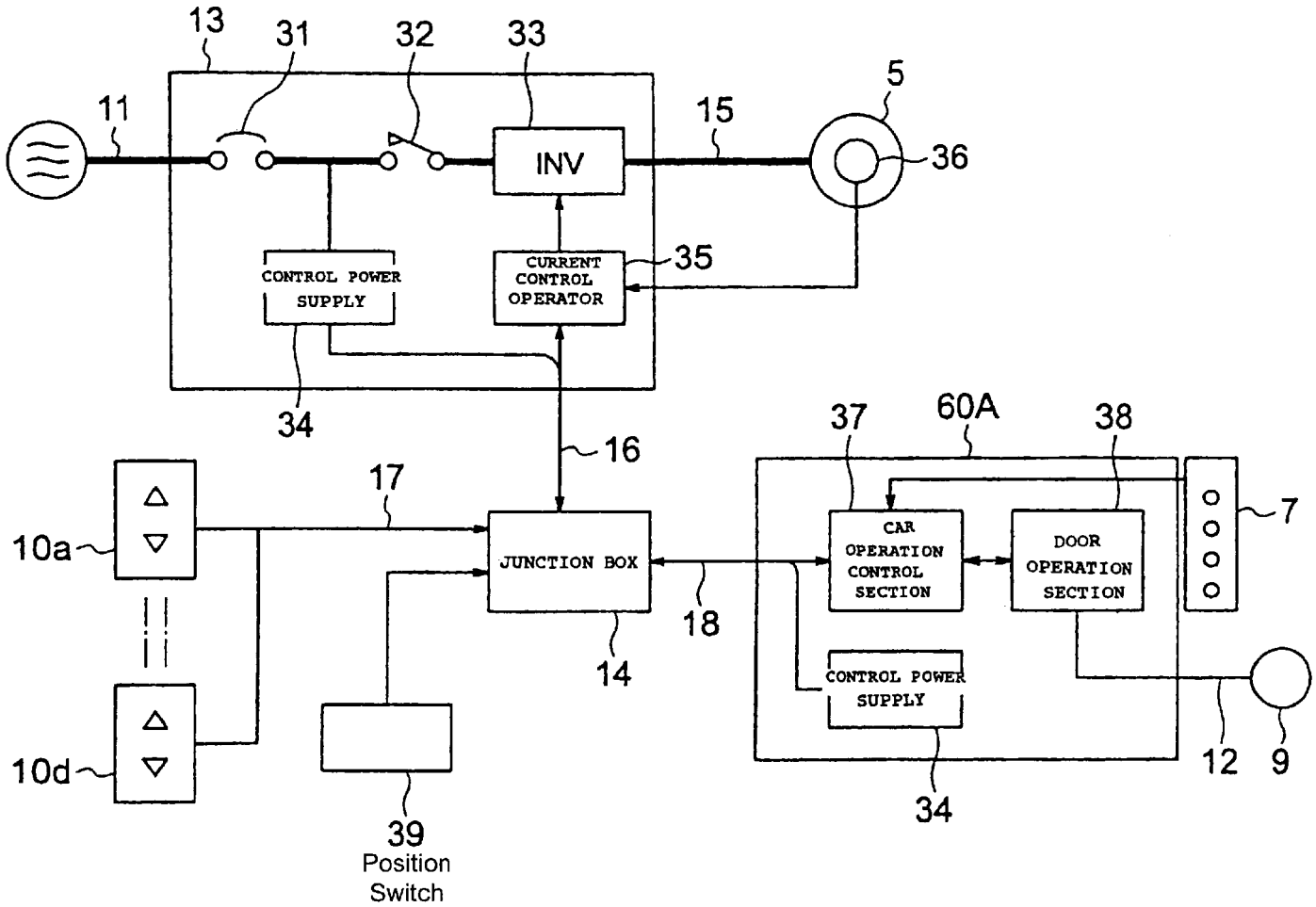
FIG. 5 is a circuit diagram showing a controlling apparatus for the elevator in accordance with embodiment 2 of this invention.

Also, FIG. 5 is a circuit diagram showing a controlling apparatus for an elevator according to embodiment 2.

In FIG. 5, numeral 31 denotes a circuit breaker for receiving and interrupting the commercial power source, numeral 32 denotes a main contactor for turning on and off the power source to be applied to an invertor 33, numeral 33 denotes the invertor for the traction motor drive, numeral 34 denotes a control power supply, numeral 35 denotes a current control operator for performing the drive control of the drive machine 4, numeral 36 denotes a pulse encoder mounted on a motor shaft of the drive machine 4 for detecting an rpm of the motor, numeral 37 a car operation control section for performing the command control such as travel stop of the car 2 or opening/closing the doors, numeral 38 denotes a door operation section for performing the control of the opening and closing of the car doors 8, numeral 39 denotes other hoist way units such as a position switch for detecting the position of the car 2 provided within the hoist way.

The operation will now be described.

The power is fed from the alternating power source 11 to the traction motor drive unit 13. This power is used to drive the traction motor 5 mainly through the circuit breaker 31, the main contactor 32, the invertor 33 and the cable 15. The other power is converted into a predetermined voltage by the control power supply 34 installed within the control panel 60A or within the traction motor drive unit 13 to be consumed in the respective control circuits and also is used for the drive of a door motor 9 but is considerably small in comparison with the above-described traction motor drive power. Thus, it is unnecessary to cause a large amount of current to flow through the cables except for the cable 15. Here, when the hall button 10 is operated, the call registration signal is transmitted to the control panel 60A through the cables 17 and 18. Also, when the car operation button 7 is operated, the destination floor registration signal is transmitted to the car operation control section 37 of the control panel 60A, the car operation control section 37 urges the main contactor 32 within the traction motor drive unit 13, and at the same time, outputs a motor torque command to the current control operator 35 so that the car may travel in accordance with a predetermined velocity pattern up to the destination floor from the start floor. The current control operator 35 drives the invertor 33 so as to have a predetermined torque on the basis of the pulse input from the pulse encoder 36 and the torque command value to thereby control the current of the traction motor 4.

Since the controlling apparatus is thus constructed, the power cable through which a large amount of current flows through the control units is only the cable 15 for connecting the traction motor drive unit 13 and the traction motor 4. Also, since the traction motor drive unit 13 is located immediately in the vicinity of the traction motor 4, the length of the cable is very short. Accordingly, it is unnecessary to lay the cable over the entire car travel to thereby suppress the cable cost. In addition, since the power cable length is the shortest, it is possible to suppress the generation of the unnecessary radiative electromagnetic noise radiated from the cable. Incidentally, the opening/closing operation of the doors may be attained by the door operation section 38 of the control panel 60A as in the conventional manner.

Accordingly, with respect to the maintenance property of the units, the maintenance of the control panel 60A may be performed inside the car cabin as in the conventional manner. Also, since the maintenance of the main circuit portion (traction motor drive unit 13) is performed while basically interrupting the power, it is possible to perform the maintenance easily from above the car in the same manner as for the drive machine. This is not inferior to the conventional manner at all.

Figure 6:
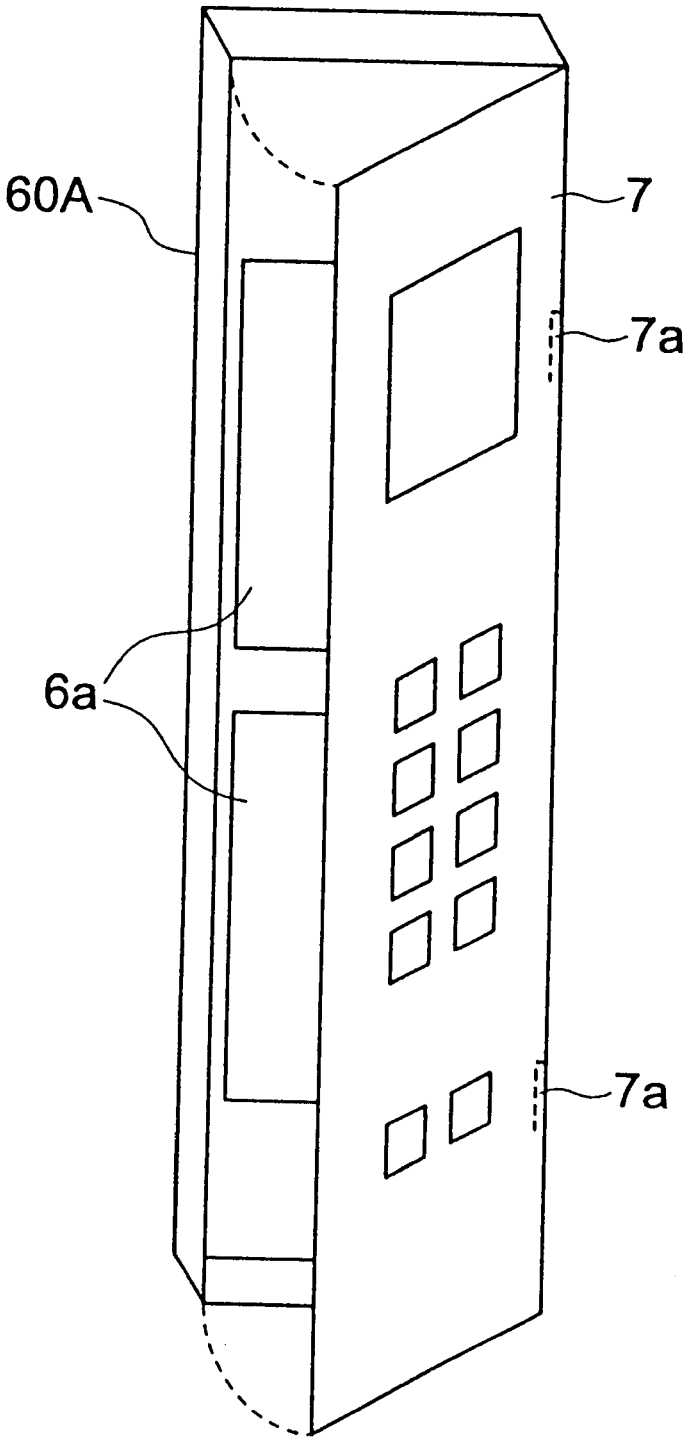
FIG. 6 is a view showing a mounting method of a car operation button to the control panel in accordance with embodiment 2.

Furthermore, FIG. 6 shows an example of how to mount the car operation button 7 onto the control panel 60A. For instance, a front plate (face place) of the car operation button 7 confronting the car cabin may be opened and closed by a hinge 7*a* as shown. According to this arrangement, it is possible to dispense with the front panel of the control panel 60A. At the same time, upon the maintenance work, it is also possible to easily access the internal units such as the control panel interior substrate 6*a* or the like by opening the car operation button 7.

Incidentally, the installation position of the drive machine 4 is at the upper portion of the hoist way 1 as shown in FIG. 4, and is different from the lower portion of the drive machine way as in the embodiment 1. This does not affect the concept of the present invention. Unlike the foregoing example, the traction motor drive unit 13 which is a control panel belonging to the drive machine 4 includes the power receiving section 401 relative to the drive machine control section 300 shown in FIG. 1 and is provided with the circuit breaker 31 and the main contactor 32. Furthermore, the hall operation panel 10 is a divided unit installed in the hall including the hall devices supervising section 503 and the hall call registration section 502 shown in FIG. 1 and the factors of the hall buttons 10*a* to 10*d* and is installed on each hall in this embodiment 2. Also, in case of the embodiment 2, the hoist way unit 39 is not connected to the divided units of the hall but connected through the junction box 14 to the control panel 60A which is the control unit of the car 2.

The control panel 60A is provided with a door operation section 38 including the door opening/closing supervising section 202 and the car door control section 203 shown in FIG. 1, and the car operation control section 37 composed of the car call registration section 102, the car devices supervising section 201, the hoist way unit supervising section 503, the call assignment section 103, the travel administration section 104 and the velocity command section 105 shown in FIG. 1.

Thus, the optimum arrangement of each control factor is different in accordance with a type of the elevator.

Incidentally, although not described in detail here, there are many opinions as to how to use the power source for each control factor. In embodiment 2, the control power supply 34 is divided and arranged for the traction motor drive unit 13 and the control panel 60A. Since the power that is needed in the hall operation panel 10 is small, especially there is no control power supply but the operation panel is supplied from the power source of another divided unit. Thus, also in the power source, it is preferable that the power source is suitably divided and arranged as in the control factor according to this invention.

Embodiment 3

Figure 7:
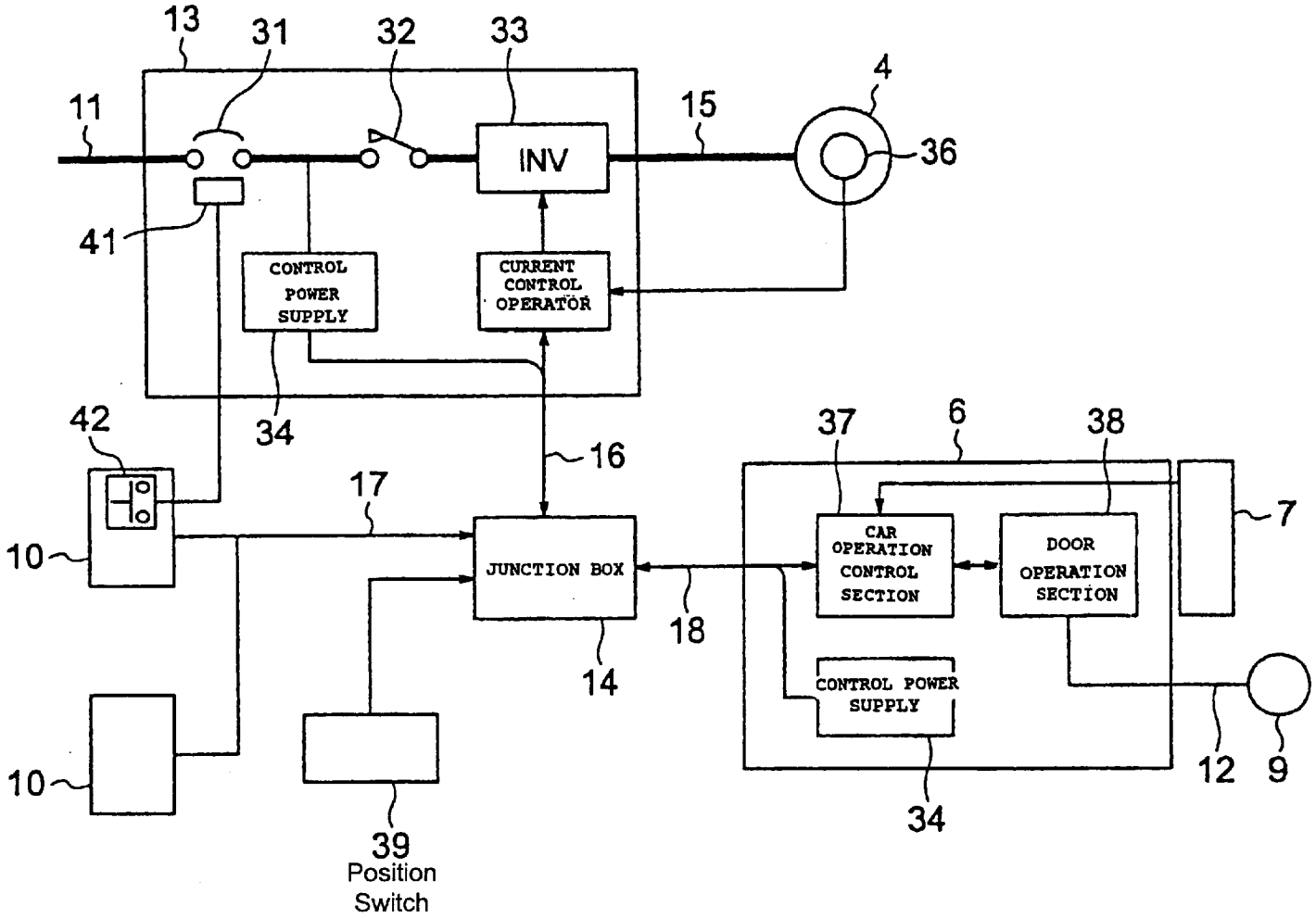
FIG. 7 is a circuit diagram showing a controlling apparatus for an elevator in accordance with embodiment 3 of this invention.

FIG. 7 is a circuit diagram showing a controlling apparatus for an elevator in which a main power source may be turned on and off from the hall, in accordance with embodiment 3 of the present invention.

In FIG. 7, new numeral 41 denotes an electrical remote operation unit mounted on the circuit breaker 31 for enabling the turn-on and -off of electricity, and numeral 42 denotes a remote operation switch of the circuit breaker built in the hall operation panel 10 on a predetermined floor. The other structures are the same as those shown in FIG. 5, and the explanation therefor will be omitted.

In the structure shown in FIG. 7, the break or connection of the elevator power source is possible from the hall to thereby further enhance the maintenance property. Also, although not shown, if a small-sized switch is used for the remote operation switch 42 provided within the hall operation panel 10, even if the hall operation panel 10 is small in size, it is possible to assemble it into the panel. There is no fear that the aesthetic design aspect of the hall is deteriorated at all. Incidentally, it is not always necessary to use an electrical remote operation but it is possible to use a mechanical one by using a wire or the like.

Namely, in embodiment 3, since the power receiving section 401 shown in FIG. 1 is installed within the traction motor drive unit 13 at the upper portion of the hoist way, the operation of the circuit breaker 31 would be inconvenient without any countermeasure. However, the remote operation unit 41 of the circuit breaker 31 is provided in the power receiving section 401 and the remote operation switch 42 therefor is provided and installed in the hall operation panel 10, i.e., at the hall devices supervising section 503 shown in FIG. 1 to perform the break and connection of the circuit breaker 31 by the remote operation switch 42 through the signal transmission between the hall devices supervising section 503 and the power receiving section 401.

Embodiment 4

Figure 8:
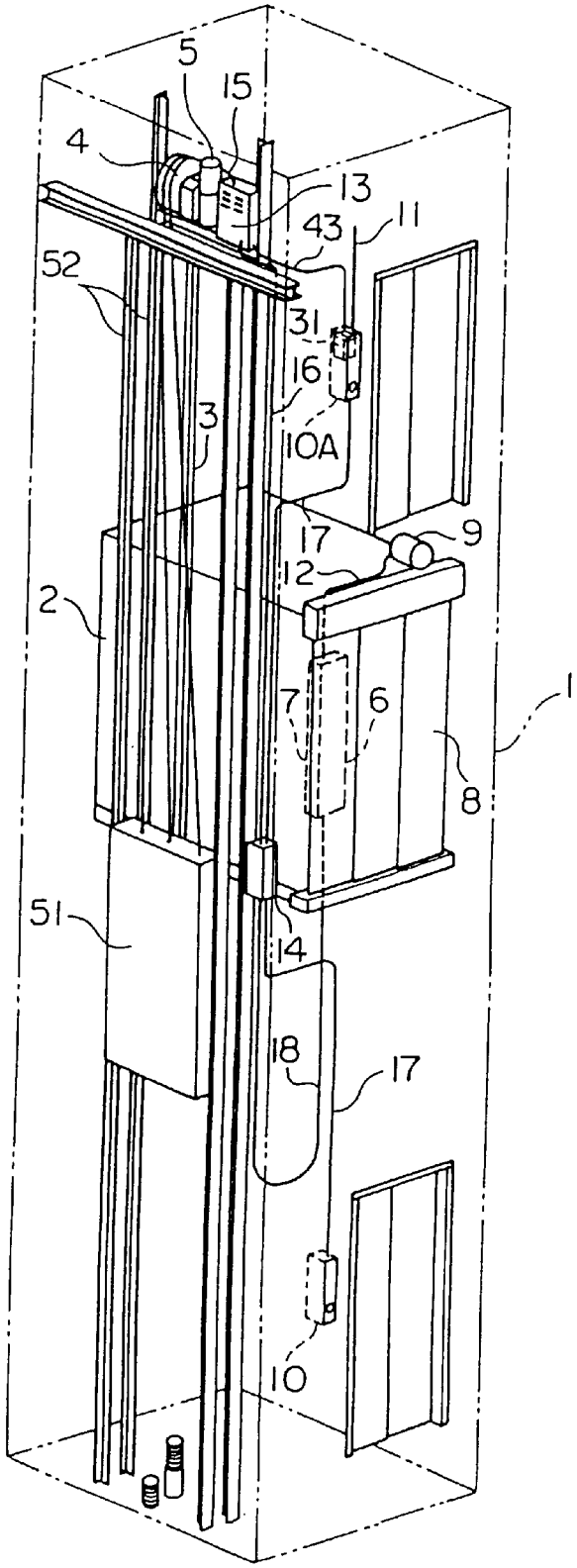
FIG. 8 is an overall structural view showing an elevator in accordance with embodiment 4 of this invention, in which machine room is provided.

FIG. 8 is an overall structural view showing a controlling apparatus for an elevator where no machine room is provided in accordance with embodiment 4 of this invention and a power source receiving function is built in the hall operation panel.

In FIG. 8, new numeral 43 denotes a power cable for connecting the traction motor drive unit 13 and a hall operation panel 10A provided on a predetermined floor and having a power receiving function. In this case, if the circuit breaker 31 is built in the hall operation panel 10A, even if any remote operation unit is provided, it is possible to perform the break and connection of the power source with ease at the hall.

Figure 9:
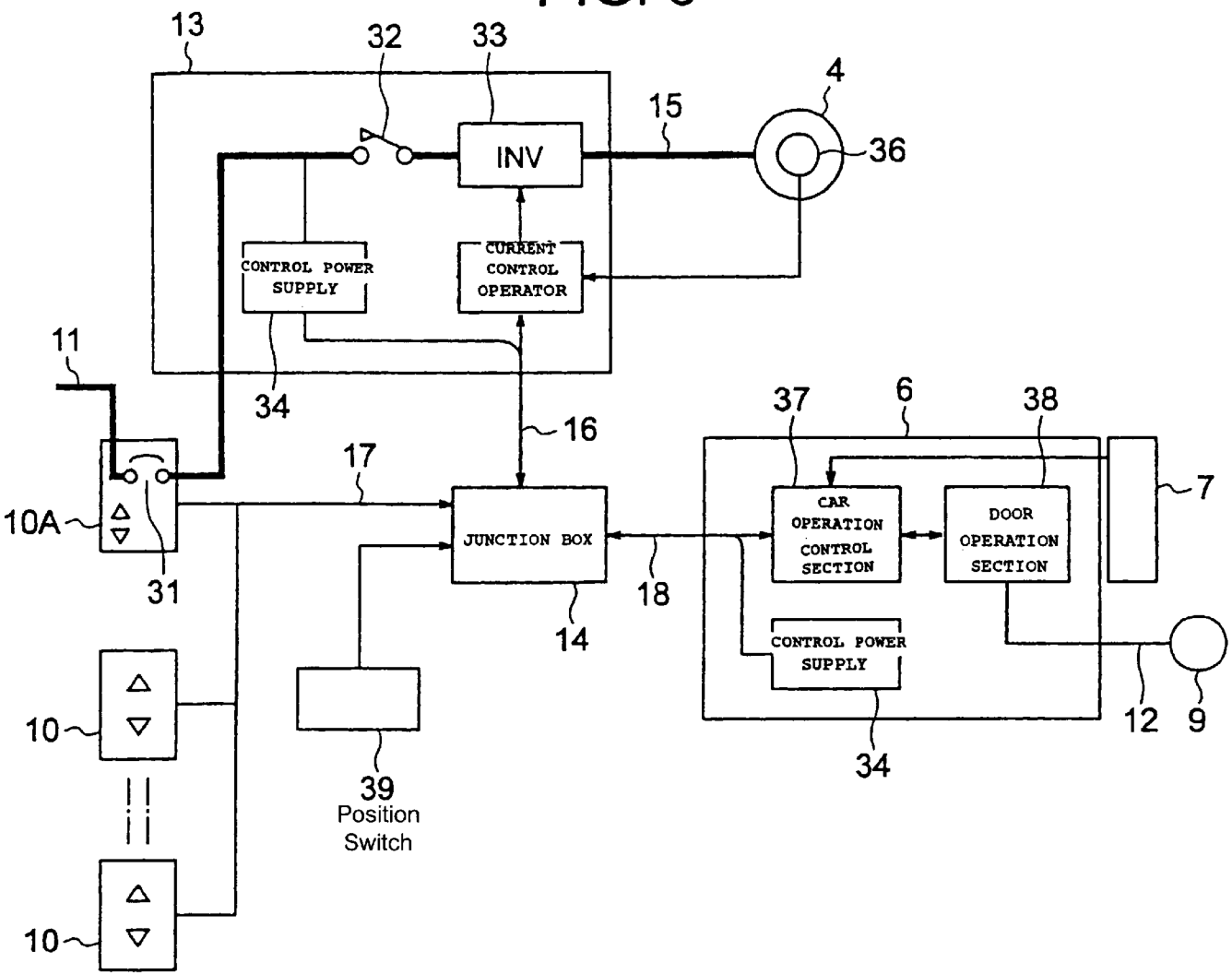
FIG. 9 is a circuit diagram showing a controlling apparatus for the elevator in accordance with embodiment 4 of this invention.
Figure 10:
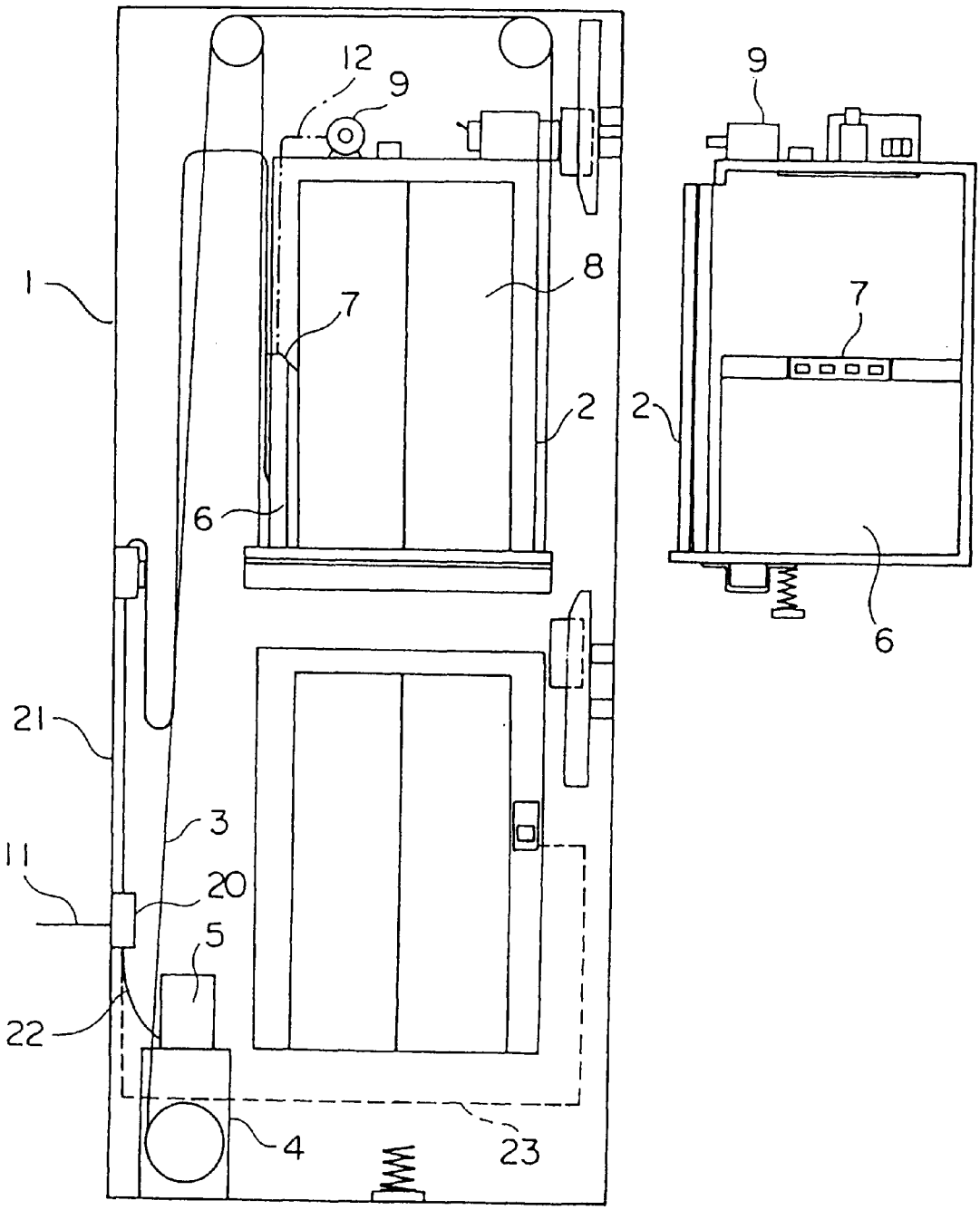
FIG. 10 is an overall structural view showing a conventional elevator in which no machine room is provided.

FIG. 9 is a circuit diagram showing the controlling apparatus for an elevator where no machine room is provided and the power source receiving function is built in the hall operation panel 10A in accordance with embodiment 4 of this invention.

In the embodiment 4, the power receiving section 401 shown in FIG. 1 and provided with the circuit breaker 31 is moved on the hall side from the drive machine control section 300, divided and arranged in place. In the hall operation panel 10A shown in FIG. 8, only this power receiving section 401 is arranged in the specified hall operation panel 10A.

When the power source of the elevator is turned off upon, for example, the maintenance work, since the circuit breaker 31 is installed in the hall, the divided unit may interrupt the power without riding on the car 2 or entering the hoist way 1. Also, since the confirmation of the interruption may readily be performed, it is possible to enhance the workability.

Also, in many cases, a terminal on a primary side of the circuit breaker 31 becomes an administration responsibility critical point between the elevator part and the local power substation part of the building as a power supply route to the elevator. It is possible to perform the maintenance and inspection of the mutual administration regions without a person in charge of the electrical part of the building entering the administration region of the elevator part.

Also, in the embodiment 4, only the power receiving section 401 is disposed in the specified hall operation panel 10. The invention is not limited to this embodiment. The apparatus is provided with the circuit breaker 31 of the power receiving section 401 and the hall devices control section 500 provided with the control panel function such as the hall operation panel 10A and the hall call registration section 502, the hoist way/hall devices supervising section 503, the hall information command section 501. The hall operation panel 10A and the hall devices control section 500 may be arranged on the hall operation panel (whose included function is different from that of the hall operation panel 10A of FIG. 9) which is the same divided control panel.

Incidentally, in the foregoing respective embodiments, the car operation buttons are built in the control panels. However, it is possible to ensure the same effect even by installing the control panels in another place where the control panels may be accessed inside the car cabin, for example, an extra wall of the car or a floor of the car separately from the car operation buttons.

Also, in the foregoing embodiments, the elevator is, for example, of the traction type in which the drive machine is disposed in the upper portion thereof. However, the same effect may be ensured with another structure in which no machine room is provided as in a traction type where the drive machine is provided in a lower portion of the hoist way or a drum winding type.

As described above, to sum up this invention, the invention is embodied in accordance with the following modes and may enjoy the resultant effect in accordance with the modes.

According to this invention, in the controlling apparatus for an elevator, in which the doors of the car are closed and started to ascend or descend by the operation of the destination call, the current position where the car ascends or descends is detected to output a predetermined velocity command, the power received is drivingly controlled in accordance with the above-described velocity command, the power drivingly controlled is fed to thereby generate the drive power to the drive machine, and provided with the control panel for descending/elevating the car to the floor which is designated by the destination call, the control panel is divided into a plurality of divided units in accordance with every control function; and the divided units to be connected or to be controlled are divided into a plurality of units groups mainly in accordance with a location where the units are disposed, a single or a plurality of divided unit groups composed of divided units having a strong relationship with at least one unit of the unit group are extracted to form a control section, and the control section is disposed in the vicinity of the unit group. Thus, the quick control reflecting the localized situation is possible for the units to which the divided units are connected. Also, since the only specified function is installed on each unit, its shape may be conformed with the place where the unit is to be installed, and the shape into which the installation property is considered may be taken. As a result, since, the divided unit is dispersedly arranged without needs of the large integral control panel as in the conventional technology, it is possible to install the apparatus in an empty space around the units to be connected without preparing a special machine room and to effectively utilize the building while enhancing the layout property of the unity.

Also, the transmission systems for communicating signals with each other between a plurality of control sections are provided so that only the effective signals are sent and received mutually. Namely, most of the signals to be received and sent between the individual control sections are different from each other in accordance with their combination. If these are installed individually, the apparatus becomes complicated. However, by installing the transmission systems for the purpose of the transmission of the signals between the individual control sections, it is possible to send and receive only the effective signals for each other.

Also, by performing the serial transmission through the above-described transmission systems, if the system is wired, it is possible to reduce the signal lines between the individual control sections. Also, even if the system is wireless, the channels for transmission may be reduced.

Also, the divided unit group comprises at least one of a divided unit composed of a drive control section for drivingly controlling a drive machine, a divided unit composed of a velocity supervising section for measuring and supervising a rotational condition of the drive machine and a divided unit composed of a velocity control section for controlling the drive control section in comparison with the rotational condition of the drive machine in accordance with a velocity command, and wherein the control section including the divided units is disposed in the vicinity of the drive machine. The lines for connecting the control section and the unit group such as the hoist may be shortened, and the installation may be easy. Furthermore, a fine control that is intimate with the units may be performed through the local control.

Also, if the elevator is an elevator in which the drive machine is disposed within the hoist way, the control section is disposed within the hoist way in the vicinity of the drive machine so that the control function relating to the drive machine may be disposed within the hoist way in the vicinity of the drive machine to thereby dispense with the conventional machine room. Namely, the drive machine disposed in the machine room is disposed within the hoist way so that the conventional control panel is left in the conventional machine room. However, according to the present invention, the function of the control panel is divided, the control function relating to the hoist may be disposed within the hoist way in the vicinity of the drive machine to thereby dispense with the conventional machine room.

Also, the divided unit includes a divided unit composed of the car call registration section for registering the car call on the basis of the operation of the call button of the car operation panel provided in the car, at least one of a divided unit composed of a call assignment section for selecting the call to be responded to for the registered call and responding to the call, a travel administration section for opening/closing doors of the car in response to the call and issuing a travel command, a velocity command section for outputting a command of travel velocity in response to a position where the car travels, and a divided unit composed of a car door control section for drivingly opening/closing the doors of the car. The divided unit group is composed of at least two divided units, and the control section including the divided unit group is disposed in the vicinity of the car operation panel. The adjusting person or maintenance person of the elevator may easily access upon the work.

An openable door is formed on a portion of a wall, a floor or a ceiling forming the car cabin and the control section is received in the interior of the door. As a result, the adjusting person or maintenance person of the elevator may easily access upon the work.

A front plate (face plate) of the car operation panel provided in the car, confronting the car cabin, is openable/closable, and the control section is received in the opened front plate. As a result, the front plate in which the conventional car operation panel is openable and closable is utilized. Accordingly, it is unnecessary to provide an extra door in the car cabin to thereby enhance the aesthetic design aspect of the car cabin.

Also, the divided unit group comprises at least one of a divided unit composed of a car door control section for drivingly controlling a door machine for opening/closing doors provided in the car, a divided unit composed of a door opening/closing supervising section for receiving a signal from a door opening/closing detector for detecting an opening/closing condition of the opening/closing doors and for supervising the doors, and a divided unit composed of a car devices supervising section for receiving a signal detected from a unit mounted around the car and for supervising the unit, wherein the control section including the divided unit group is mounted on the car. As a result, the control functions which are strongly related to each other are united into the same control section. Accordingly, the fine control is possible. Also, the large number of the signal lines that are conventionally used to connect each other over the car and the machine room may be dispensed with.

The divided unit group comprises at least one of a divided unit composed of a hall call registration section for registering a hall call on the basis of the operation of the call button of the hall operation panel provided at the hall and a divided unit composed of a hoist way/hall devices supervising section for receiving and supervising a signal detected from a unit mounted within the hoist way or the unit mounted at the hall, wherein the control section including the divided unit group is disposed in the vicinity of the hall or inside or outside of the hoist way. As a result, it is possible to perform the quick control while reflecting the localized situation for the units to which the divided units are connected.

Also, the divided unit group is a divided unit group including a divided unit composed of a power receiving section for receiving a power fed to the elevator from an local power substation of a building, and the control section including the divided unit group is disposed in the vicinity of the hall. As a result, it is possible to readily perform the break and connection of the elevator power source.

A remote operation unit is mounted on a circuit breaker of a power receiving section for receiving a power fed from an local power substation of the building to the elevator, a remote operation switch for remotely operating the remote operation unit is provided at the hall, and the result of the operation of the remote operation switch is transmitted to the remote operation unit through the control section. Accordingly, it is possible to readily perform the break and connection of the elevator power source when the person stays in the hall.

Also, a switch for a power circuit is mounted on a power receiving section for receiving a power fed from an local power substation of the building to the elevator, a remote operation switch for remotely operating the switch is provided at the hall, and the result of the operation of the remote operation switch is transmitted to the switch through the control section. Accordingly, by operating the switch, it is possible to readily perform the break and connection of the elevator power source when the person stays in the hall.

Also, the divided unit comprises at least one of a divided unit composed of a power receiving section for receiving a power fed from an local power substation of the building to the elevator, a divided unit composed of an environmental supervising section for inputting and supervising an electricity amount received by the power receiving section or for receiving an emergency signal detected by an emergency sensor, a divided unit composed of an operation supervising section for performing an operational administration of the elevator by outputting operation information of the elevator for alarming to an operator monitor panel or inputting the operation of the elevator inputted from the operator monitor panel, a divided unit composed of a remote supervising section for communication and control with a maintenance part for remotely supervising the elevator, wherein the control section including the divided unit is disposed in the vicinity of the hall of the elevator or an equipment administration chamber of the building for installing the elevator, the administration of the elevator is easy, and also, for example, the integration with the operator monitor panel may reduce the number of the units.

Also, the control section is a control section composed of at least one divided unit installed in the hoist way. An openable/closable outlet/inlet inside the car is provided in a ceiling portion of the car for maintenance and inspection of the control section, it is possible to access the peripheral wall from the ceiling portion of the car cabin to thereby enhance the freedom degree of the position of the inner wall of the hoist way on which the corresponding control section is mounted.

Furthermore, the control section is disposed in the hoist way and positioned upwardly of an upper portion of the ceiling portion of the car cabin when the car stops at the uppermost floor. Accordingly, after the elevator is stopped at the uppermost floor and the power is interrupted, it is possible to start the opening work of the inlet/outlet of the car ceiling.

INDUSTRIAL APPLICABILITY

According to this invention, a control panel is divided into a plurality of divided units in accordance with every control function, units to be controlled or connected of the divided unit is divided into a plurality of unit groups summed in accordance with a place where the unit is to be disposed, and one or a plurality of divided unit groups of the divided units having a strong relationship with at least one unit of the unit group is extracted to form a control section, the control section is disposed in the vicinity of the unit group so that it is unnecessary to provide a large integral control panel, there is no difficulty in finding an installation place for the control panel, it is unnecessary to prepare a special machine room, it is possible to provide it in an empty space around the respective unit to be controlled, it is possible to effectively use the building while enhancing the layout property of the units and it is possible to perform a quick control while reflecting a localized situation for the unit to be controlled.

What is claimed is:

1. A controlling apparatus for an elevator comprising a control panel for controlling various units of the elevator, wherein:

the control panel is divided into a plurality of divided units in accordance with each control function; and the divided units are divided into a plurality of unit groups in accordance with locations where the units are disposed, divided units having a relationship with at least one unit of the unit group extracted to form a control section, and the control section is disposed proximate the unit group.

2. The controlling apparatus for an elevator according to claim 1, further comprising a transmission system for communication of signals between a plurality of control sections.

3. The controlling apparatus for an elevator according to claim 2, wherein the transmission system transmits signals in serial transmission.

4. The controlling apparatus for an elevator according to claim 1, wherein a unit group comprises at least one of a divided unit composed of a drive control section for controlling a drive machine, a divided unit composed of a velocity supervising section for measuring and supervising a rotational condition of the drive machine, and a divided unit composed of a velocity control section for controlling the drive control section in comparison with a velocity command, and the control section is disposed proximate the drive machine.

5. The controlling apparatus for an elevator according to claim 4, wherein the drive machine is disposed in a hoist way and the control section is disposed in the hoist way proximate the drive machine.

6. The controlling apparatus for an elevator according to claim 1, wherein a unit group comprises:

a divided unit composed of a car call registration section for registering a car call based on operation of a call button of a car operation panel provided in an elevator car; and at least one of a call assignment section for selecting the call to be responded to for the registered call and responding to the call, a travel administration section for opening and closing doors of the elevator car in response to the call and issuing a travel command, a velocity command section for outputting a travel velocity command in response to a position where the elevator car travels, and an elevator car door control section for opening and closing the doors of the elevator car, wherein the unit group is composed of at least two divided units and the control section including the unit group is disposed proximate the car operation panel.

7. The controlling apparatus for an elevator according to claim 6, including an openable door on a portion of one of a wall, floor, and ceiling of the elevator car wherein the control section is received in the door.

8. The controlling apparatus for an elevator according to claim 6, including a front plate on the car operation panel, located in the car, that is openable and closable, and wherein the car operation panel is open when the control section is received in the front plate.

9. The controlling apparatus for an elevator according to claim 1, wherein the unit group comprises at least one of a car door control section for controlling a door machine for opening and closing doors of an elevator car, a door opening and closing supervising section for receiving a signal from a door opening and closing detector for detecting opening and closing of the doors and for supervising the doors, and a car devices supervising section for receiving a signal from a unit mounted around the car and for supervising the unit, wherein the car door control section including the unit group is mounted on the elevator car.

10. The controlling apparatus for an elevator according to claim 1, wherein a unit group comprises at least one of a hall call registration section for registering a hall call based on operation of a call button of a hall operation panel provided at a hall, and a hoist way and a hall devices supervising section for receiving and supervising a signal from one of a unit mounted within a hoist way and the hall operation panel provided at the hall, wherein the control section including the unit group is disposed at one of proximate the hall, inside the hoist way, and outside the hoist way.

11. The controlling apparatus for an elevator according to claim 10, wherein the unit group is composed of a power receiving section for receiving power fed to the elevator from an local power substation of a building, and the control section including the unit group is disposed proximate the hall.

12. The controlling apparatus for an elevator according to claim 10, including a remote operation unit mounted on a circuit breaker of a power receiving section for receiving power fed from a local power substation of the building to the elevator, a remote operation switch for remotely operating the remote operation unit located at the hall, and operation of the remote operation switch is transmitted to the remote operation unit through the control section.

13. The controlling apparatus for an elevator according to claim 10, including a switch for a power circuit mounted on a power receiving section for receiving power fed from a local power substation of the building to the elevator, and a remote operation switch for remotely operating the switch in the hall, wherein operation of the remote operation switch is transmitted to the switch through the control section.

14. The controlling apparatus for an elevator according to claim 1, wherein a the divided unit comprises at least one of a power receiving section for receiving power fed from a local power substation of the building to the elevator an environmental supervising section for inputting and supervising electricity amount received by the power receiving section and for receiving an emergency signal an emergency sensor, an operation supervising section for operational administration of the elevator by outputting operation information of the elevator by sending an alarm to an operator monitor panel or inputting operation of the elevator from the operator monitor panel, and a remote supervising section for communication and control with a maintenance part for remotely supervising the elevator, wherein the control section including the divided unit is disposed proximate the hall or an equipment administration chamber of the building for the elevator.

15. The controlling apparatus for an elevator according to claim 1, wherein the control section includes at least one divided unit installed in the hoist way, an openable and closable outlet and inlet inside an elevator car in a ceiling of the elevator car for maintenance inspection of the control section.

16. The controlling apparatus for an elevator according to claim 15, wherein the control section is disposed in the hoist way and positioned upwardly of the ceiling of the elevator car when the car stops at an uppermost floor.

* * * * *